US007311648B2

(12) United States Patent
Petersen

(10) Patent No.: US 7,311,648 B2
(45) Date of Patent: Dec. 25, 2007

(54) METHOD FOR STAMPING A BENDING EDGE IN A PACKAGE MATERIAL

(76) Inventor: Jes Hilfing Petersen, Kyhnsvej 3, DK-2930, Klampenborg (DK)

( * ) Notice: Subject to any disclaimer, the term of this patent is extended or adjusted under 35 U.S.C. 154(b) by 0 days.

(21) Appl. No.: 10/967,422

(22) Filed: Oct. 18, 2004

(65) Prior Publication Data

US 2005/0107232 A1 May 19, 2005

Related U.S. Application Data

(63) Continuation-in-part of application No. 10/469,798, filed as application No. PCT/DK02/00053 on Jan. 25, 2002, now abandoned.

(30) Foreign Application Priority Data

Mar. 6, 2001 (DK) ..... 2001 00364
Jun. 19, 2001 (DK) ..... 2001 00950

(51) Int. Cl.
*B31B 1/25* (2006.01)
*B31B 49/02* (2006.01)

(52) U.S. Cl. ..... 493/61; 493/143; 83/875

(58) Field of Classification Search ..... 493/53, 493/61, 69, 79, 167, 396, 397, 143; 83/875, 83/879, 880, 882
See application file for complete search history.

(56) References Cited

U.S. PATENT DOCUMENTS 4,064,409 A * 12/1977 Redman ..... 310/306
5,073,162 A * 12/1991 Campbell et al. ..... 493/396
6,364,590 B1 * 4/2002 Gayoso ..... 412/18

FOREIGN PATENT DOCUMENTS

EP 189909 A2 * 8/1986
JP 51-017547 2/1976
JP 07-304963 5/1997
WO WO 00/76759 A1 12/2000

* cited by examiner

*Primary Examiner*—Rinaldi I. Rada
*Assistant Examiner*—John Paradiso
(74) *Attorney, Agent, or Firm*—William J. Sapone; Coleman Sudol Sapone P.C.

(57) ABSTRACT

Stamping of a layer (2) of package material, such as cardboard or plastics, for forming one or more bending edges may take place according to the invention by a method wherein a stamping tool (8), which is provided with preferably three ribs (9*a, b, c*), is pressed down into the layer (2) and thereby forms slots (11*a, b, c*) in the bending edge in one working cycle. The stamping may take place very precisely, and since the stamping is carried out in one working cycle, an uprecedentedly high production rate may be achieved. Since the stamping tool does not need a lower tool part, but merely a support (10), the stamping may be performed simultaneously with the punching in one and the same working cycle.

6 Claims, 5 Drawing Sheets

METHOD FOR STAMPING A BENDING EDGE IN A PACKAGE MATERIAL

CROSS REFERENCE TO RELATED APPLICATIONS

This application is a continuation in part of application Ser. No. 10/469,798 filed Sep. 3, 2003 now abandoned, which was a national stage filing of PCT International application no. PCT/DK02/00053 filed Jan. 25, 2002.

BACKGROUND

The invention relates to a method of stamping a bending edge in a layer of package material, such as cardboard or plastics, for use in the manufacture of a box or the like, formed with bends, by means of a stamping tool which is pressed down for forming the bending edge, as well as to a tool for performing the method.

In principle, package boxes are made by punching a cardboard workpiece in a punching tool. This workpiece is dimensioned such that by folding it can form the finished box.

To ensure a predetermined position of the bending edge, the workpiece is stamped to form a downwardly pressed bending edge in the bending line in a stamping tool. This is normally a working process which takes place at the same time as the punching of the cardboard workpiece.

Normally, this stamping takes place by means of a tool having a rib and cooperating lower part having a groove in which the downwardly pressed cardboard material and the rib may be received.

This method therefore requires a high degree of precision of the tool as well as of the machine, since the tool parts must be arranged and controlled very precisely in order to make the completely uniform slot at the right location in the cardboard workpiece.

Since, as mentioned, the stamping normally takes place at the same time as the actual punching of the workpiece, there are physical limits as to how far the stamping can proceed toward the end where the punching takes place. The reason is that the tool does not allow a procedure that permits full extension of the stamping tool since there is simply no room for the punching tool. Therefore, the stamped slot cannot extend in the full extent of the bending line but must stop a distance before the end edge at the cutting.

The only way of solving this will be to stamp in an independent working process, but since this is both an uneconomic and inaccurate way of production, this is normally not possible in practice.

The stamped slot itself, which consists of a downwardly pressed slot, forms a longitudinally extending bead on the lower side. When the workpiece is to be folded or bent, this normally takes place over the bead, which will thereby constitute an internally extending thickening in the bending line, while the outer side is formed by the bottom of the slot.

The actual folding or bending takes place over the downwardly pressed material part and will not be perfectly sharp in case of thick cardboard. This is caused partly by the width of the slot and partly by the different fiber direction that results in various tensile stresses in the edge area. In addition to this there are the problems involved by the circumstance that the slot does not extend right out to the end, so that in these areas the bending takes place entirely without stamping. All in all, this results in a disuniform external edge.

A further consideration is the tensile impact to which the cardboard is subjected by the bending, and which is so great that the cardboard has to be dimensioned to be able to accommodate this tensile stress. Therefore, the load is frequently the parameter according to which the entire cardboard must be dimensioned.

The specification of EP 0 189 909 A2 discloses an apparatus for stamping one or more slots in a layer by means of one or more balls or rolls which are advanced across the cardboard to form the slot. The advancement takes place by means of a programmable control of a carriage having a holder in which the stamping tool is mounted, said parts being movable in the x- and y-directions of the cardboard.

The stamping thus takes place in a progressing movement in the track of the bending line. This is a slow method which has been developed for the stamping of individual pieces. Therefore, this method cannot be used for a rational production of workpieces, since the apparatus can only stamp individual workpieces by a progressing downward pressing of the slot.

OBJECT OF THE INVENTION

The object of the invention is to remedy these drawbacks of the known methods, and this is achieved according to the invention by a method wherein the stamping tool is provided with at least two stamping ribs which extend in the full extent of the bending edges, more preferably, wherein the stamping tool includes stamping ribs formed in a piece of flexible material, preferably steel plate, which may either be mounted in a printing, stamping, punching rotary machine, or in a plano-machine, said stamping ribs being pressed down into the layer resting on a support for forming the finish-stamped workpiece in one working cycle.

This provides considerable improvements. Primarily an unprecedentedly high production rate, since the stamping of the complete stamping pattern takes place in one and the same working cycle, which may optionally be combined with a further treatment, such as punching, sheet application, printing, etc.

The downward pressing of the ribs may take place either in a plane or a rotary movement of the tool against the layer on the support.

Further, this stamping is very precise, since all stampings are completely uniform on the finished product and thereby very accurate and with sharp and uniformly extending finished bending edges.

The stamping may take place in connection with the printing and punching process, as the stamping part with the ribs may be formed e.g. on one of the rollers in a rotary printing machine or on the upper part in a stamping press. Hereby, the stamping may take place simultaneously with printing and punching, application of sheet, etc., thereby ensuring a rational production.

When two, but preferably three, slots are stamped, the slots may constitute a form of pleating, and the opening will automatically be symmetrical around the central slot that will constitute and extend in the bending line.

When the slots are dimensioned according to the nature of the cardboard with respect to tear force and fiber direction, etc., the stamping, with respect to number of slots and their size mutually as well as with respect to width and depth, may be adapted to achieve an accurately extending bend with out any risk of overloading of the material in the bending area.

When the depth in the individual slots is adapted to the fiber direction, the strength of the material in the bending material may remain optimum.

Finally, it is expedient to form the actual stamping tool with ribs in a thin steel plate, since the tool may hereby be mounted on a cylinder or roller in an ordinary rotary machine or in a printing unit on a sheet offset machine.

BRIEF DESCRIPTION OF THE DRAWINGS

The method according to the invention will be described more fully below with reference to the drawings, in which.

DETAILED DESCRIPTION OF THE INVENTION

Figure 1:
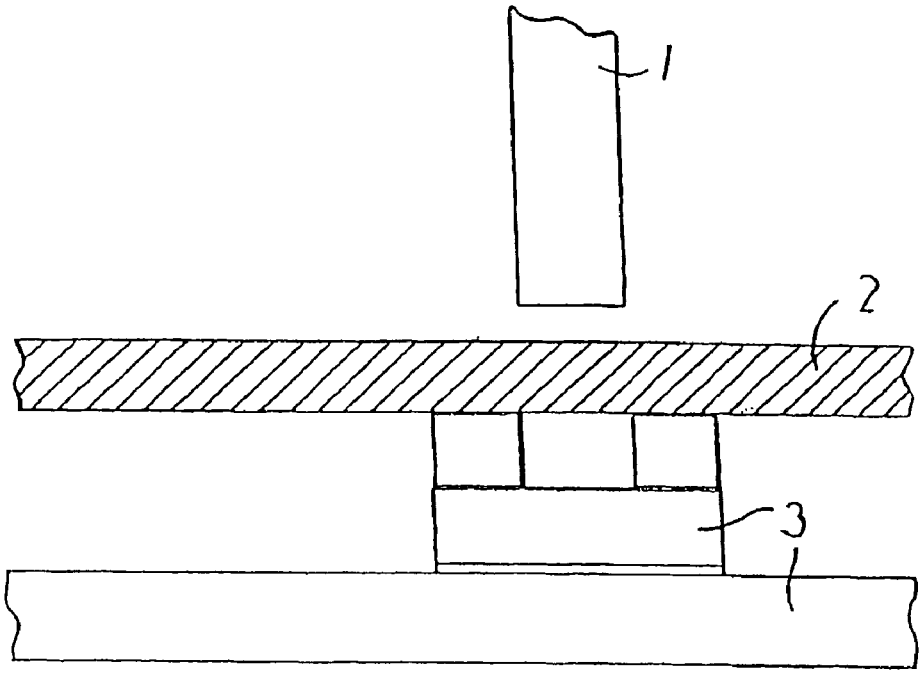
PRIOR ART FIG. 1
FIG. 1 shows a known stamping tool prior to stamping.
Figure 2:
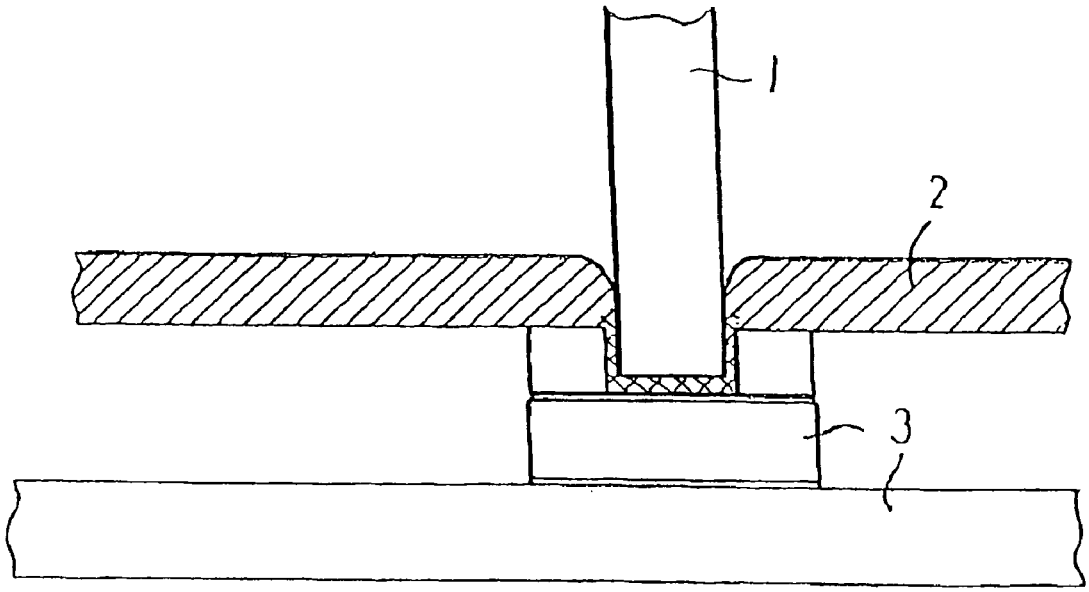
PRIOR ART FIG. 2
FIG. 2 shows the known tool during stamping.

First, a known method of stamping cardboard for forming a bending edge will be described with reference to FIGS. 1-4. In FIG. 1, the cardboard member 2 is shown disposed in a stamping tool which comprises a lower part 3 and an upper part with the downward pressing part 1.

Figure 3:
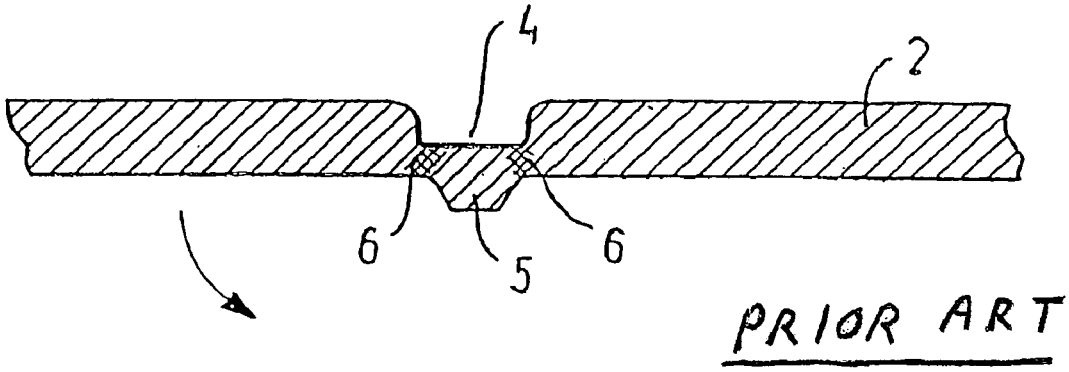
FIG. 3 shows the known stamping seen in section prior to bending.

When this upper part 1 is pressed down in the lower part 3, the cardboard 2 will be deformed to form a slot 4 on the upper side and a bead 5 on the lower side, as shown in FIG. 3.

It is observed that compression of the material takes place on both sides of the slot 4, as indicated in FIG. 3.

Figure 4:
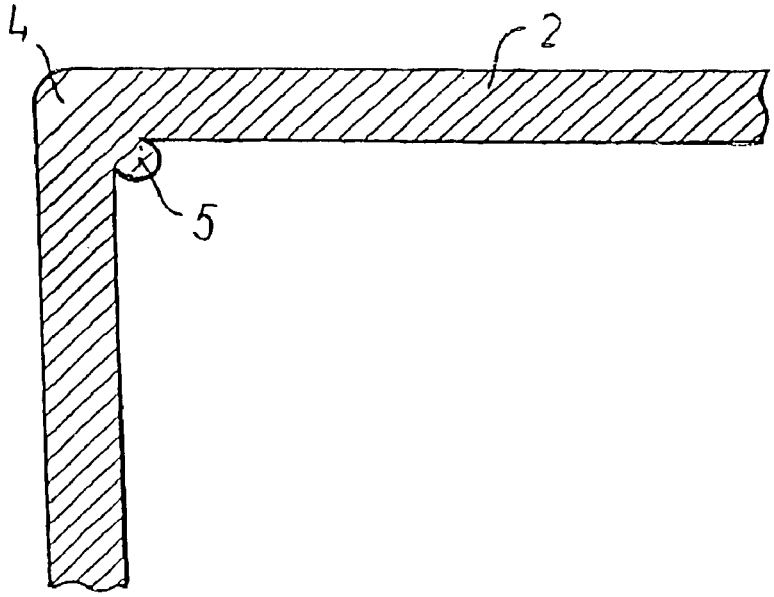
FIG. 4 PRIOR ART
FIG. 4 shows the known stamping seen in section after bending.

When such cardboard 2 is then bent to form a corner, as shown in FIG. 4, the bead 5 will constitute the internal corner, while the depressed material at the bottom of the slot 4 will constitute the external corner.

As indicated in FIG. 4, the material will be stretched here, involving the risk that the fibers in the edge area are ruptured or break entirely or partly.

This method therefore results in a weakening of the material in the edge area, just as it is a complicated matter to mount and adjust the tool with an entirely accurate mutual position before the stamping can be performed. Also, bending can only be carried out in one direction, viz. in the direction away from the depression 4 as indicated by an arrow in FIG. 3.

The actual bending is moreover dependent on the thickness of the material as well as the fiber direction, and, particularly in case of thick cardboard, this may cause the bending edge to be non-sharp and disuniform.

The method according to the invention will now be described with reference to FIGS. 5-10, which illustrate an example of the stamping of cardboard 2, either in sheet shape or as a web, the number of bending lines (11*a, b* and *c*) being three.

Stamping in a layer of plastics may take place in a quite corresponding manner, optionally with simultaneous application of heat.

Here, the stamping tool just comprises an upper part 8, which is provided with two or more ribs, preferably three ribs 9. The number of ribs should preferably be an odd number, since the bending can then proceed around the slot of the central rib. Normally, the ribs 9 extend mutually in parallel to form straight mutually parallel slots.

Figure 8:
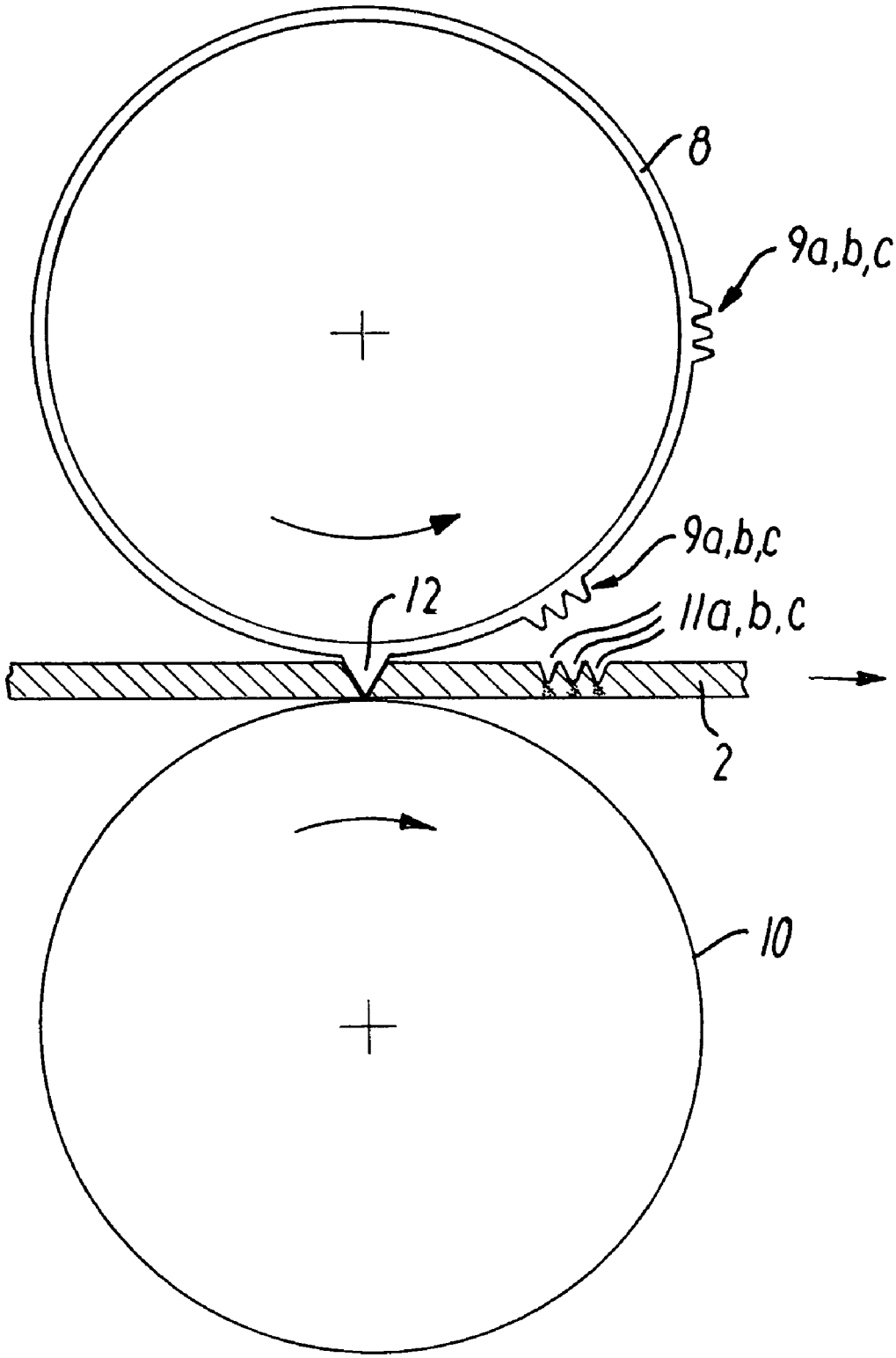
FIG. 8 shows the stamping tool seen in section mounted on a cylinder in a rotary machine.

The upper part 8 with ribs 9 may be constructed as a rigid tool member where the stamping takes place by a plane movement against a fixed support 10. Or the upper part 8 with ribs 9 may be made of a thin and thereby flexible steel plate, as shown in FIG. 8, allowing the tool to be mounted on a cylinder or roller and thereby to be used in an ordinary rotary machine or to be mounted in a sheet offset machine. Alternatively, it may be mounted in a sheet offset machine.

The ribs 9*a-c* are shown with a certain mutual spacing and with the same width and depth, but this is just to illustrate an example. Thus, the cross-sectional shape, mutual spacing or depth may be varied, just as the number of ribs, everything in order for the bending area to be stamped as expediently as possible according to the material and the dimensions.

Figure 5:
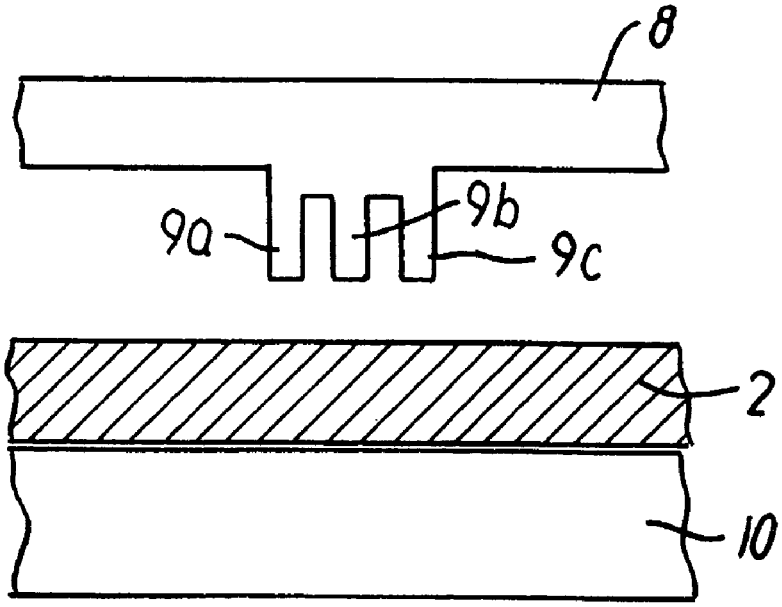
FIG. 5 shows a stamping tool according to the invention prior to stamping.
Figure 6:
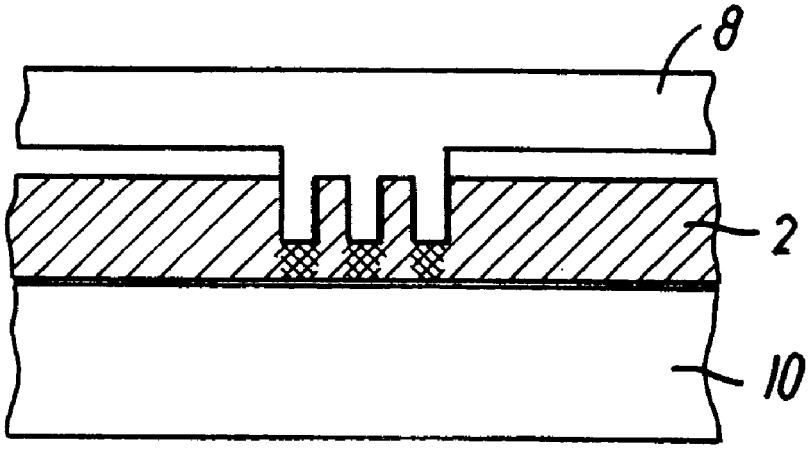
FIG. 6 shows a stamping tool according to the invention during stamping.

The cardboard 2 is arranged below the tool 8, 9 on a support 10, as shown in FIG. 5. When the tool 8, 9 is then pressed down into the cardboard 2, three slots 11*a-c* will be formed, as the material is compressed below the ribs 9*a,b,c*, as indicated in FIG. 6.

In the event that the stamping is to be performed on a rotary machine, the tool is mounted on a roller, and the cooperating counter-roller will constitute the support.

Figure 7:
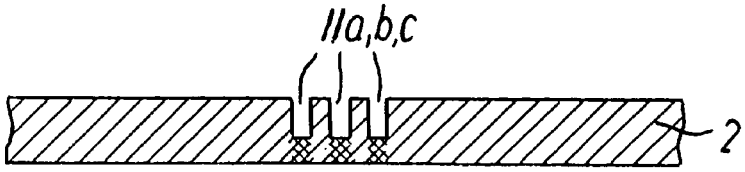
FIG. 7 shows the stamping according to the invention seen in a section.

Then, the finish-stamped cardboard presents three slots 11*a,b,c*. as shown in FIG. 7.

Figure 9:
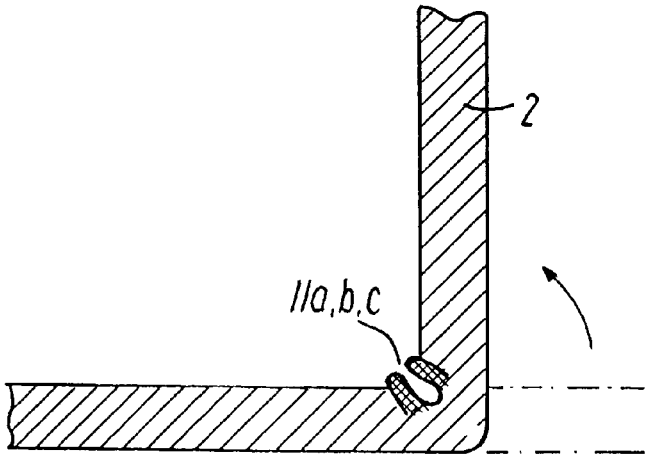
FIG. 9 shows the stamping according to the invention seen in a section after bending in a direction toward the slots; and, FIG. 10 shows the stamping according to the invention seen in a section after bending in a direction away from the slots.

When subsequently bending is performed in the direction toward the slot, as indicated by an arrow at the top of FIG. 7 to form a bending edge, as shown in FIG. 9, it may be observed that the slots 11*a,b,c* will constitute perfect openings for the material, so that there will be no accumulation of material internally.

The compressed material will be extended and be distributed, and the procedure will be very much like a homogeneous material, since no stretching will take place, but rather an extension of the compressed material.

Hereby, the bending will be very sharp and proceed very precisely, just as the bending will automatically be controlled around the central slot 11*b*, and proceed from there evenly outwards toward the external slots 11*a* and 11*c*.

Figure 10:
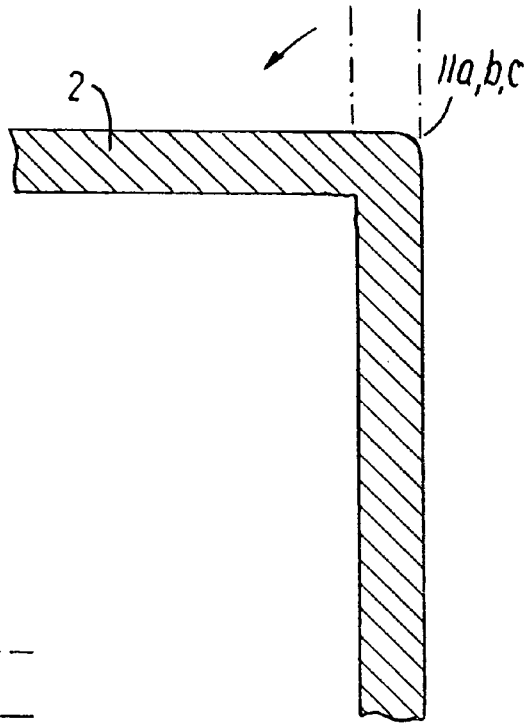

The stamping, however, also allows bending in the direction away from the slots, as indicated by an arrow in FIG. 10. The resulting bending edge, which is shown in FIG. 10, will involve an insignificant bead internally in the bending corner, but apart from this, the bending is just as perfect in this bending direction as in the opposite one in terms of sharpness and strength of the edge, as the stretching of the fibers takes place in an area where compressed fibers are available.

Since hereby there is no special load, the cardboard may be dimensioned to be thinner and optionally of a poorer quality than known before. This allows a more extensive use of e.g. recycled cardboard or other materials where the fibers are arranged randomly or are more or less destroyed.

The method is also unique in being independent of a lower tool part. This rationalizes the manufacture of cardboard packages, since more working processes may take place in one and the same working cycle/machine.

The tool with ribs may thus be used in an ordinary plano-punching/stamping machine, in a printing unit on a sheet offset machine or in a rotary printing machine as shown in FIG. 8. This simplifies and reduces the costs of the stamping operation considerably, just as the quality of the finished product is more uniform and sharp, to which should be added the strength which the material has, and thereby the quality of the cardboard package.

In the example mentioned above, it is implied that the ribs and thereby the slots extend in straight lines, but, of course, nothing prevents the ribs from being interrupted to form e.g. tear lines, cuts as indicated on the tool in the form of a cutting edge 12 in FIG. 8 or they may be wave-shaped to form an uneven bending line.

While preferred embodiments of the present invention have been shown and described, it will be understood by those skilled in the art that various changes or modifications can be made without varying from the scope of the present invention.

What is claimed is:

1. A method of stamping a bending edge in a layer of package material, such as cardboard or plastics, for forming a workpiece for use in the folding of the package material to manufacture a box or the like, the method comprising:

forming the bending edge by means of a stamping tool which is pressed down to form at least two slots on a stamped side of the package material that define the bending edge, while an opposite side remains substantially planer, providing a stamping tool (8) having at least two stamping ribs (9) for each bending edge which extend to the full extent of the bending edge, the at least two stamping ribs formed in a piece of flexible material, preferably steel plate, the stamping ribs corresponding to the dimensions of the bending edge to provide the bending edge as mutually spaced parallel slots;

mounting the stamping tool in a machine selected from the group consisting of printing, stamping, punching rotary machines, or in a plano-machine;

providing a level support having no grooves for receiving the stamping ribs;

resting the layer of packaging material on the level support; and, pressing down said stamping ribs (9) into the layer (2) resting on the level support (10) to form a finish-stamped workpiece containing the bending edge made of parallel slots on the stamped side, the opposite side remaining substantially planar, in one step.

2. The method according to claim 1 further comprising providing the stamping tool (8) with at least three stamping ribs (9*a-c*) for forming the bending edge so that a central rib (9*b*) forms a slot (11*b*) which extends centrally in the bending edge.

3. The method according to claims 1 wherein the number of stamping ribs (9), their stamping depth, transverse extent and mutual spacing correspond to a thickness of the layer (2) and a transverse extent of the bending edge.

4. The method according to claims 1 wherein a stamping depth of the bending edge is defined relative to a fiber direction of the package material so that the depth is greatest transversely to the fiber direction.

5. The method according to claim 1 further comprising simultaneously stamping a plurality of bending edges in the layer of package material.

6. The method according to claim 1 further comprising mounting the flexible material on a cylinder and rolling the flexible plate over the surface of the layer of package material, for pressing down the stamping ribs into the package material for forming the bending edge in one step.

* * * * *